United States Patent [19]

Crow

[11] 4,214,658

[45] Jul. 29, 1980

[54] SMOKING SYSTEM

[75] Inventor: Floyd Crow, Cresthill, Ill.

[73] Assignee: Simple Pleasures, Inc., Romeoville, Ill.

[21] Appl. No.: 935,675

[22] Filed: Aug. 21, 1978

[51] Int. Cl.[2] ..... A24F 9/00

[52] U.S. Cl. ..... 206/244; 206/250; 206/253; 206/236

[58] Field of Search ..... 206/236, 237, 244, 246, 206/249, 250, 252, 267, 253; 217/62

[56] References Cited

U.S. PATENT DOCUMENTS

| | | | |
|---|---|---|---|
| 498,695 | 5/1893 | Powell | 206/236 X |
| 1,039,892 | 10/1912 | Buckow | 206/236 |

FOREIGN PATENT DOCUMENTS

| | | | |
|---|---|---|---|
| 340656 | 10/1959 | Switzerland | 206/252 |
| 390732 | 4/1933 | United Kingdom | 206/249 |

*Primary Examiner*—Herbert F. Ross

*Attorney, Agent, or Firm*—Laff, Whitesel & Rockman

[57] ABSTRACT

A smoking system is provided to hold a smoking pipe and smoking material in a compact container and provide a quick and efficient method to fill the pipe with the smoking material.

6 Claims, 3 Drawing Figures

SMOKING SYSTEM

BACKGROUND OF THE INVENTIOn

This invention relates to a smoking system and more particularly, to a smoking system to hold a smoking pipe and smoking material in one compact container.

Present day smoking systems designed to hold a pipe and smoking material with which to fill the pipe are generally cumbersome and inconvenient to carry about. Further, these smoking systems do not provide a quick and efficient method to fill the pipe with the smoking material. Another disadvantage of present systems is that it is often difficult to detach the pipe and fill it with the smoking substance in a dark or dimly lit room. Thus there is a need for a simple, compact smoking system.

Accordingly, a primary object of the present invention is to provide a new and improved smoking system which consists of a single, compact receptacle for holding a pipe, and smoking material with which to fill the pipe.

Another object of my invention is to provide a novel smoking system, comprising a receptacle for holding a pipe and smoking material, whereby the pipe can be removed from the receptacle without inverting the receptacle, thereby preventing the loss of smoking material while removing the pipe.

Yet another object of my invention is to provide a compact smoking system whereby a smoker can fill a pipe with smoking material in a dark or partly lit room with ease and convenience.

Still another object of my invention is to provide a pipe-holding smoking system including a bias means for automatically exposing a pipe from a receptacle for removal and use when the receptacle is opened.

An additional object of my invention is to provide a simple, compact smoking system which may be used quickly and efficiently.

In the preferred embodiment of my invention, a smoking pipe is held in a first cavity of a rectangular-shaped receptacle and smoking material is stored in a second cavity of the receptacle. A slidably mounted cover prevents the contents of the receptacle from falling out. Pressure means are provided in the first cavity to move the pipe partly out of the cavity when the cover is moved to open the cavity. Thus, the pipe can be removed without turning the device upside down, thereby preventing loss of the smoking material.

DETAILED DESCRIPTION OF THE INVENTION

Figure 1:
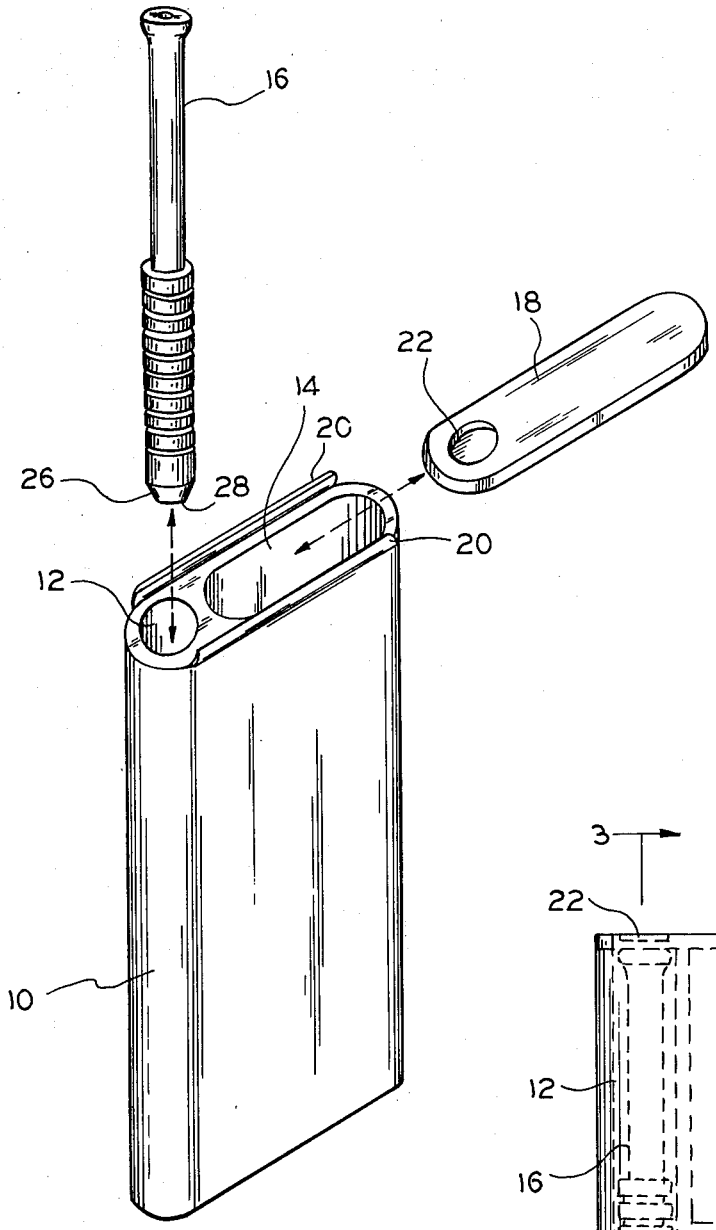
FIG. 1 is an exploded perspective view of the disclosed invention.
Figure 3:
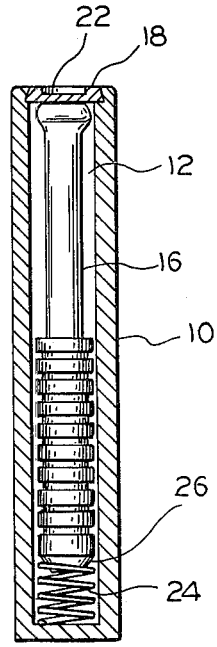
FIG. 3 is a cross-sectional view of the inventive smoking devicle along line 3—3 of FIG. 2.
Figure 2:
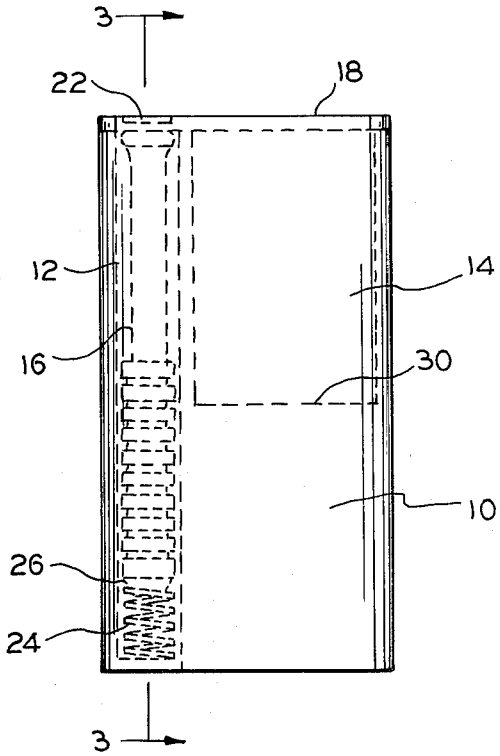
FIG. 2 is a side elevation view of the inventive smoking device.

As shown in FIGS. 1 and 2, a smoking system constructed in accordance with my invention comprises a receptacle 10 with cavities 12 and 14 therein. Cavity 12 is shaped to receive smoking pipe 16 and cavity 14 is designed to store a quantity of loose smoking material, such as tobacco. Cover 18 slidably fits between guides 20 on the top of receptacle 10, and is provided with finger recess 22 to facilitate moving the cover in the guides. When in place, cover 18 extends over both cavities 12 and 14 to prevent either pipe 16 or the tobacco material from falling out of the receptacle.

At the bottom of cavity 12 is a resilient element 24, such as a spring or spongy material which urges smoking pipe 16 upwardly when the pipe is placed in cavity 16.

When cover 18 is in place over cavity 12, pipe 16 is forced downward against the bias of resilient element 24, and element 24 is thereby compressed. By sliding cover 18 to open cavity 12, resilient element 24 acts to raise pipe 16 in cavity 12. The length of cavity 12 is approximately equal to the length of pipe 16. Thus, when cover 18 is moved to uncover cavity 12, pipe 16, under the influence of resilient element 24 rises whereby the top of pipe 16 extends above receptacle 10 and can easily be gripped by the fingers and removed from the cavity for use. In this manner, pipe 16 can readily be removed from receptacle 10 without turning the receptacle over, thus preventing tobacco material from spilling from cavity 14.

The operation of my unique smoking system is as follows:

Cover 18 is first withdrawn by placing a finger in recess 12 and sliding cover 18 towards the center of the receptacle thereby exposing pipe 16. Pipe 16 is then displaced upwardly under the bias of resilient element 24, until the tip of the pipe extends slightly above the top of receptacle 10. The pipe 16 is then grasped by the fingers and easily removed from cavity 12 without having to invert receptacle 10. Cover 18 is then moved in the opposite direction in guides 20, exposing cavity 14 and the smoking substance contained therein. The bowl 26 of pipe 16 is then pressed into the smoking material and the pipe is moved up and down until the bowl 26 at the tip of pipe 16 is filled with smoking material. A sharp edge 28 is provided at bowl 26 to cut away excess smoking material when forced against bottom 30 of cavity 14 while packing the smoking material in the bowl 26. The pipe can then be lighted and smoked, and the receptacle 10 secured by sliding cover 18 over the receptacle to its closed position.

It is apparent therefore, that the present invention provides a simple and compact smoking system to hold a pipe and smoking material. In addition, the pipe can be removed and packed with the smoking material quickly and efficiently.

While the principles of the invention have been described above in connection with a specific embodiment and applications, it is to be understood that this description is made only by way of example and not as a limitation on the scope of the invention.

I claim:

1. A smoking system comprising: a receptable having a first cavity and a second cavity therein, said second cavity being shallower than said first cavity and having a thick base; openings in said receptacle leading to each of said cavities; smoking pipe means removably disposed in said first cavity and having a bowl portion disposed on one end thereof; the length of said smoking pipe means being greater than the depth of said second cavity; smoking material disposed in said second cavity whereby said bowl portion of said smoking pipe means can be filled with said smoking material by inserting said smoking pipe means in said second cavity and tamping said bowl portion of said smoking pipe means against said thick base of said second cavity while gripping the other end of said smoking pipe means; cover means associated with said receptacle across said openings of said cavities, said cover means movable to alternatively close or expose one or both of said cavities.

2. The smoking system of claim 1 including a resilient element disposed in said first cavity, whereby said pipe compresses said resilient element when said pipe is in said cavity and said cover closes said first cavity, and said resilient element biases said pipe to expose a portion of said pipe above said receptacle when said cover is moved to open said first cavity.

3. The smoking system of claim 2 wherein said resilient element is a spring.

4. The smoking system of claim 2 wherein said resilient element is a spongy material.

5. The smoking system of claim 1 wherein said cover is slidably mounted on said receptacle between a pair of guides associated with said receptacle.

6. The smoking system of claim 1 wherein said cover means includes a recess formed in the top surface at one end of said cover means.

* * * * *